United States Patent [19]

Pamler

[11] Patent Number: 4,715,734

[45] Date of Patent: Dec. 29, 1987

[54] PLATEN ADJUSTING MECHANISM

[75] Inventor: Gerhard Pamler, Nuremberg, Fed. Rep. of Germany

[73] Assignee: Ta Triumph-Adler Aktiengesellschaft, Nuremberg, Fed. Rep. of Germany

[21] Appl. No.: 915,997

[22] Filed: Oct. 6, 1986

Related U.S. Application Data

[63] Continuation of Ser. No. 667,578, Nov. 2, 1984.

[30] Foreign Application Priority Data

Nov. 5, 1983 [DE] Fed. Rep. of Germany ..... 3340046

[51] Int. Cl.[4] ..... B41J 11/20

[52] U.S. Cl. ..... 400/56; 400/58; 400/637.2

[58] Field of Search ..... 400/55, 56, 57, 58, 400/59, 60, 637, 637.1, 637.2, 637.3, 637.4, 642, 643, 645.4, 645.5, 649, 661, 689

[56] References Cited

U.S. PATENT DOCUMENTS

| | | | |
|---|---|---|---|
| 657,187 | 9/1900 | Webb | 400/637.3 X |
| 2,611,469 | 9/1952 | Haas et al. | 400/637.2 X |
| 3,171,699 | 3/1965 | Maxey | 384/222 |
| 4,247,213 | 1/1981 | Wurscher | 400/689 |

FOREIGN PATENT DOCUMENTS

| | | | |
|---|---|---|---|
| 1282660 | 11/1968 | Fed. Rep. of Germany | 400/56 |
| 51376 | 5/1981 | Japan | 400/58 |

OTHER PUBLICATIONS

IBM Technical Disclosure Bulletin, vol. 13, No. 10, Mar. 1971, p. 3070, "Multiple Copy Control for Typewriters" by Walton.

IBM Technical Disclosure Bulletin, vol. 26, No. 4, Sep. 1983, pp. 1834–1835, "Spring-Loader Round Platen" by Bratton et al.

*Primary Examiner*—Charles A. Pearson

*Attorney, Agent, or Firm*—Browdy and Neimark

[57] ABSTRACT

An arrangement of a paper guide trough supporting pressure rollers to guide paper about the platen of a typewriter is used in conjunction with a platen having an elastic bearing to effect an automatic adjustment of the platen according to the thickness of paper inserted to maintain the same printing plane without additional components.

3 Claims, 3 Drawing Figures

PLATEN ADJUSTING MECHANISM

This application is a continuation of application Ser. No. 667,578, filed Nov. 2, 1984.

This invention relates to platen adjusting mechanism for typewriters or like machines; more particularly it relates to an arrangement of a paper guide trough and a platen having an elastic bearing whereby the platen is forced to adjust to accomodate the thickness of an inserted paper pack.

A related co-pending application of Gerhard Pamler is U.S. Ser. No. 613,269 filed May 24, 1984, titled Elastic Bearings for Shafts now U.S. Pat. No. 4,573,816.

BACKGROUND OF THE INVENTION

It is known in the art to provide means for adjusting the platen to accomodate different paper thicknesses. U.S. Pat. No. 4,365,900 is an example of such a platen adjusting device wherein adjustment is by an operator-controlled lever. Such prior art devices are relatively expensive requiring, for example, a roll carrier mounted for movement relative to the machine frame and adjustable by means of a hand controlled lever which acts upon eccentrics. The guiding means and the eccentrics must be so precise that the resultant adjustment of the platen is parallel to its basic position. This requires high costs for parts and assembly, and the parts must be produced with close tolerances. It is also of disadvantage in the known adjusting devices that the operator of the typewriter or printer often forgets to make the appropriate platen adjustment for proper passage of the paper so that the quality of the typed material is not always the best.

In accordance with the invention a paper guide trough is so mounted relative to a platen supported on an elastic bearing such that paper insertion causes the elastic bearing to accomodate movement of the platen.

It is an object of the invention to provide a platen adjusting device of simple design with a minimum of special parts.

It is another object of the invention to provide a platen adjusting mechanism in which the platen automatically moves to accomodate the thickness of an inserted paper pack.

Other objects, features and advantages of the present invention will become better known to those skilled in the art from a reading of the following detailed description when taken in conjunction with the accompanying drawing wherein like reference numerals designate like or corresponding elements throughout the several views thereof and wherein.

Figure 1:
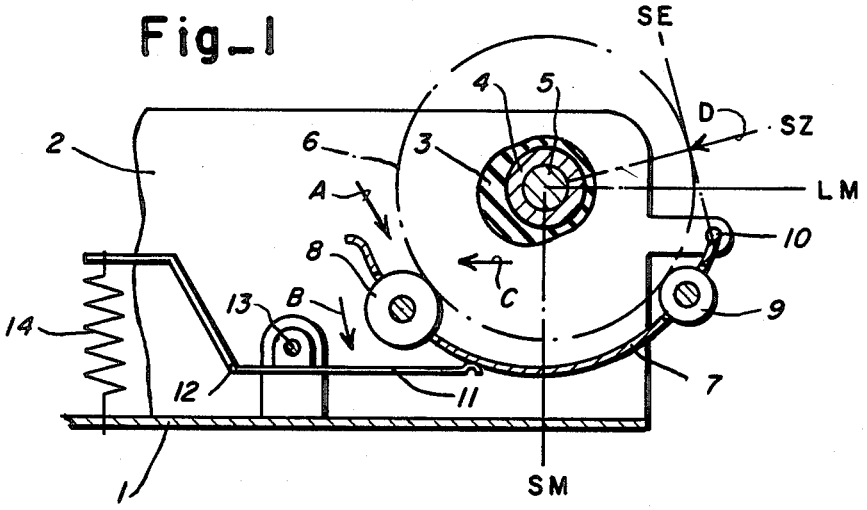
FIG. 1 is an elevational view of an arrangement in accordance with the invention.

Referring now to the drawing, there is shown in FIG. 1 a machine frame 1 having side plates 2. As disclosed in said copending application, Ser. No. 613,269, now U.S. Pat. No. 4,573,816 incorporated by reference herein, the side plates support elastic bearings 3 which accomodate bearing bushings 4 for a through shaft or end shafts 5 of a platen 6 shown in dash in dash dotted lines.

A paper guide trough 7, mounting rear 8 and front pressure rolls 9, serves to guide the paper around the platen 6. The pressure rolls 8, 9 and rotatably mounted in the paper guide trough by means of pins. The pressure rolls 8 and 9 bear against the platen 6 and at the same time see to the transport of the paper after its insertion. The front pressure rolls 9 are of smaller diameter than the rear pressure rolls 8.

Beyond the ends of the platen 6, the paper guide trough 7 is mounted laterally in the side plates 2 by pivot pins 10. The pivot pins 10 are preferably located between the imaginary, horizontal, longitudinal center plane LM through the platen 6 and the front pressure rolls 9 and are located approximately in an off vertical downwardly extending typing plane SE tangent to the platen against which types or printing pins hit the platen 6 along a line of type above the plane LM.

The paper guide trough 7 is in contact with an arm 11 of a pivoting lever 12 which is mounted at 13 in the machine frame 1 and is spring-loaded by an extension spring 14,. The extension spring 14 tends to turn the arm 11 counterclockwise, thereby assuring that the paper pressure rolls 8 and 9 are in pressure contact with the platen 6. The point of contact of the lever arm 11 on the paper guide trough 7 is selected so as to be located, viewed in printing direction, behind the vertical center plane SM through the platen 6. Due to this location the force of the spring 14 is utilized to exert a pressure on the platen by means of the rear pressure rolls 8, which pressure pushes the platen 6 in the elastic bearing 3 generally opposite to the direction of arrow C.

When paper is inserted in the direction of arrow A between the platen 6 and the paper guide trough 7, the rear pressure roll 8 is first pushed—depending on the thickness a (FIG. 2) of the paper stack—away in the direction of arrow B, i.e. the paper guide trough 7 pivots a little about the pivot pins 10. As the paper continues to be fed in, it reaches the area of the front pressure rolls 9. This creates a pressure upon the platen 6 which is absorbed by the elastic bearing 3 because the paper guide trough 7 cannot yield opposite to the direction of arrow C. This means that the platen 6 as permitted by the elastic bearing 3 yields in the direction of arrow C to enable the paper to pass between the platen 6 and the front paper guide rolls 9. It is evident therefrom that the platen 6 adjusts automatically to the thickness of the inserted paper without the need for the operator to take special measures.

When the paper is completely inserted in the typewriter, it can be typed on. Printing takes place in the direction of arrow D so that the relatively hard platen 6 can also yield due to the elasticity of the bearing 3.

The pivot pins 10 for the paper guide trough 7 are expediently disposed so that a type carrier carriage can move freely in the area of the typed line SZ without hitting the pivot pins 10. As shown, the preferred direction in which the elastic bearing 3 can yield is expediently chosen so that optimum conditions result for both the adjustment of the platen 6 and the printing in the direction of arrow D.

Figure 2:
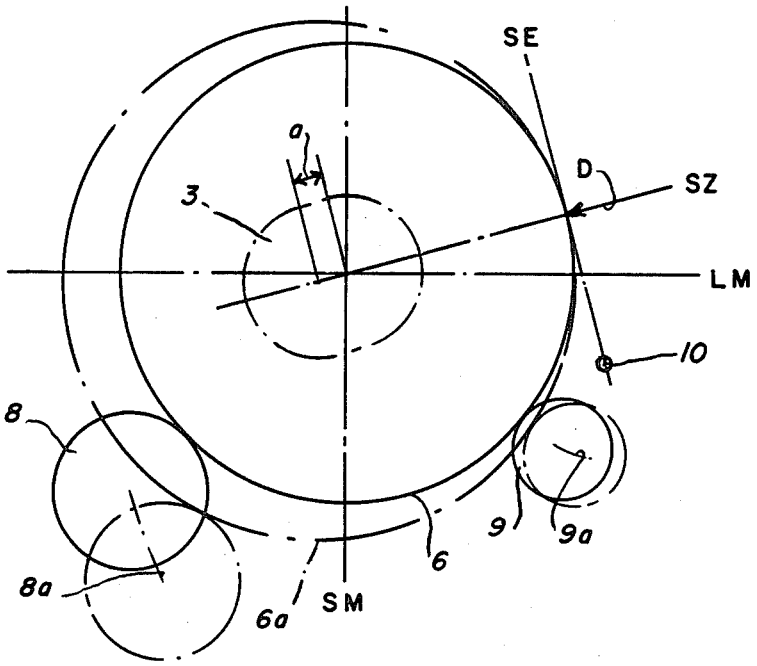
FIG. 2 is an enlarged schematic view illustrating the geometric relationship of the arrangement shown in FIG. 1.

Referring to FIG. 2, the geometrical relationship of the arrangement is illustrated. The platen 6 and the pressure rolls 8 and 9 are shown in unbroken lines in the position they assume when no paper is inserted in the device. The platen axis is coincident with the intersection of lines LM and SM. When paper is introduced, the typing plane SE should remain unchanged, regardless of the paper thickness. The dash-dotted circle 6*a*, shown tangent to typing plane SE represents a circle whose radius is that of the platen 6 plus a radius representing the paper thickness a. When paper of a thickness a is introduced, the pressure rolls 8 and 9 move along the arcs 8*a* and 9*a* whose center is the axis of the pivot pins 10. To make it possible for the paper to pass between the platen 6 and the front pressure rolls 9, the platen 6 yields as permitted by the elastic bearing 3 by a radial distance a corresponding to paper thickness in the preferred direction. Consequently, the typed line SZ always lies in the same typing plane SE.

Figure 3:
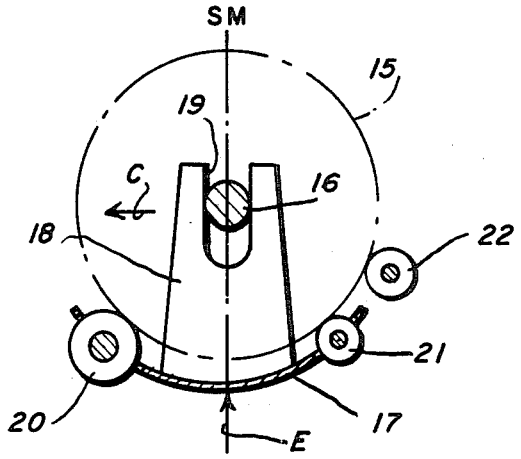
FIG. 3 is an elevational view of another embodiment of the invention.

With reference to FIG. 3 there is shown another embodiment of the invention wherein as in the FIG. 2 embodiment, the shaft 16 of the platen 15 is mounted in an elastic bearing, not shown in FIG. 3. In FIG. 3 the paper guide trough 17 has upstanding sides 18 with vertical slots 19. The slotted sides 18 grip around the platen shaft 16 so that the paper guide trough 17 can move in vertical direction. Pressure rolls 20 and 21 carried by the guide trough 17 correspond to those of FIG. 1. Disposed on the print impact side of the platen 15 is a rotatable roll 22 of roughly the same length as the platen 15. This roll is also mounted in the machine side plates 2. In this embodiment, the force of a spring, corresponding to spring 14 in FIG. 1, acts on an arm 11 which contacts the paper guide through 17 in arrow direction E in the vertical center plane SM.

If paper is inserted in this arrangement, the paper guide trough 17 is first moved opposite to the arrow direction E, countering the force of a spring (not shown) having the function of spring 14, by the paper thickness. The slots 19 permit this motion. It is only when the paper arrives between roll 22 and platen 15, that the platen 15 together with the paper guide trough 17 is pushed as permitted by yielding of the elastic bearing 3 in the direction of arrow C a distance equal to the paper thickness. This arrangement has the advantage that the pressure ratios of the pressure rolls 20 and 21 relative to the platen 15 always remain the same. To reduce the relative motion between the arm 11 and the paper guide trough 17, a roll engaging a surface of the paper guide trough 17 may be disposed on the arm 11.

The invention claimed is:

1. Automatic platen adjusting mechanism for a typewriter or like machine comprising a platen having a shaft a frame having side plates, elastic bearings supported in said side plates for supporting said platen shaft and configured to yield in a straight line direction perpendicular to a typing plane which includes a line against which types impact against said platen, a paper guide trough rotatably supporting front and rear pressure rolls on axes parallel to the axis of said platen shaft and forward and rearward respectively of a vertical line through said platen shaft axis, means biasing said paper guide trough to urge said pressure rolls into engagement with said platen, and means secured to said side plates and positioned relative to said platen to cause paper introduced into said guide trough between said platen and pressure rolls to exert pressure against said platen resulting in the yielding of said elastic bearings in said straight direction a distance equal to the thickness of the paper, said last named means comprising means on said side plate for pivotally mounting said paper guide trough on an axis parallel to the axis of said platen shaft, said paper guide trough pivot axis lying in said typing plane forward and above the axis of said front pressure rolls.

2. Automatic platen adjusting mechanism as recited in claim 1, said last named means comprising a roll secured to said side frames extending parallel to said platen axis and in contact with said platen.

3. Automatic platen adjusting mechanism as recited in claim 2, said paper guide trough having side plates provided with vertical slots embracing said platen shaft, and said paper guide trough being moveable with the platen during its movement to accomodate the thickness of the paper introduced in the paper guide trough.

* * * * *